US012495905B2

(12) United States Patent
Crowell et al.

(10) Patent No.: US 12,495,905 B2
(45) Date of Patent: Dec. 16, 2025

(54) CHAIR WITH DYNAMIC MOTION FEATURES

(71) Applicant: HNI Technologies Inc., Muscatine, IA (US)

(72) Inventors: Travis J. Crowell, Davenport, IA (US); Christopher J. Davis, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 223 days.

(21) Appl. No.: 18/277,343

(22) PCT Filed: Feb. 17, 2022

(86) PCT No.: PCT/US2022/016799

§ 371 (c)(1),
(2) Date: Aug. 15, 2023

(87) PCT Pub. No.: WO2022/178129

PCT Pub. Date: Aug. 25, 2022

(65) Prior Publication Data

US 2024/0122354 A1 Apr. 18, 2024

Related U.S. Application Data

(60) Provisional application No. 63/150,326, filed on Feb. 17, 2021.

(51) Int. Cl.
*A47C 7/44* (2006.01)

(52) U.S. Cl.
CPC ..... *A47C 7/44* (2013.01); *A47C 7/445* (2013.01)

(58) Field of Classification Search
CPC ..... A47C 7/44; A47C 7/445
(Continued)

(56) References Cited

U.S. PATENT DOCUMENTS 4,938,532 A * 7/1990 Burgess ..... A47C 7/445 297/291 X
5,577,811 A * 11/1996 Ogg ..... A47C 3/12 297/284.4

(Continued)

FOREIGN PATENT DOCUMENTS

CN 107788733 A * 3/2018 ..... A47C 7/002
EP 3400838 A1 * 11/2018 ..... A47C 1/03255

(Continued)

OTHER PUBLICATIONS

International Search Report and Written Opinion for International patent application No. PCT/US2022/016799, filed Feb. 17, 2022, mailed Jun. 2, 2022.

(Continued)

*Primary Examiner* — Rodney B White
(74) *Attorney, Agent, or Firm* — Faegre Drinker Biddle & Reath LLP

(57) ABSTRACT

A compliant chair backrest assembly includes a back frame (58) having a first frame side (58*a*), a second frame side (58*b*), a lower portion (581) and an upper portion (58*u*) that extends from the lower portion (581). The upper portion (581) of the back frame is configured to engage with a back of a user and the lower portion (581) includes a first flexural member (70) and a nexus (74). The first flexural member (70) defines a first lower contact surface (90*a*) and has a flexural rigidity. The lower portion (581) also includes a reinforcement support (62) including a first brace (100) defining a first upper contact surface (110*a*) and having a flexural rigidity that is greater than the flexural rigidity of the first flexural member (70).

19 Claims, 7 Drawing Sheets

(58) Field of Classification Search
USPC ..... 297/285
See application file for complete search history.

(56) References Cited

U.S. PATENT DOCUMENTS

| | | | | |
|---|---|---|---|---|
| 6,406,096 | B1 * | 6/2002 | Barile, Sr. | A47C 7/445 297/296 X |
| 6,471,293 | B2 * | 10/2002 | Ware | A47C 7/445 297/285 |
| 6,679,551 | B2 * | 1/2004 | Ware | A47C 7/445 297/285 |
| 6,820,934 | B2 * | 11/2004 | Ware | A47C 7/445 297/285 |
| 6,896,327 | B1 | 5/2005 | Barile | |
| 7,021,712 | B2 * | 4/2006 | Spendlove | A47C 7/445 297/285 |
| 7,226,127 | B1 * | 6/2007 | Yevko | A47C 7/46 297/285 |
| 7,234,774 | B2 * | 6/2007 | Heidmann | A47C 1/03277 297/300.1 |
| 7,681,952 | B2 * | 3/2010 | Piretti | A47C 7/445 297/297 |
| 7,862,120 | B2 * | 1/2011 | Ueda | A47C 7/445 297/285 |
| 7,866,750 | B2 * | 1/2011 | Bock | A47C 7/443 297/303.3 |
| 7,926,879 | B2 * | 4/2011 | Schmitz | A47C 1/03255 297/340 |
| 8,282,169 | B2 * | 10/2012 | Schmitz | A47C 7/462 297/411.25 |
| 8,388,064 | B2 * | 3/2013 | Bertolini | A47C 7/445 297/285 |
| 8,567,864 | B2 * | 10/2013 | Deisig | A47C 3/045 297/285 |
| 8,668,267 | B2 * | 3/2014 | Piretti | A47C 7/445 297/301.5 |
| 8,820,835 | B2 * | 9/2014 | Minino | A47C 7/44 297/285 |
| 8,876,209 | B2 * | 11/2014 | Peterson | A47C 7/445 297/452.29 |
| 8,967,726 | B2 * | 3/2015 | Schmitz | A47C 1/03294 297/452.56 |
| 8,991,924 | B2 * | 3/2015 | Piretti | A47C 7/445 297/285 |
| 8,998,339 | B2 * | 4/2015 | Peterson | A47C 1/03279 297/285 |
| 9,004,596 | B2 * | 4/2015 | Barile, Jr. | A47C 3/04 297/297 |
| 9,192,237 | B2 * | 11/2015 | Bachar | A47C 7/445 |
| 9,408,467 | B2 * | 8/2016 | Peterson | A47C 7/44 |
| 9,504,325 | B2 * | 11/2016 | Sander | A47C 1/03255 |
| 9,572,432 | B2 * | 2/2017 | Deisig | A47C 7/44 |
| 9,648,956 | B2 * | 5/2017 | Peterson | A47C 7/44 |
| 9,668,580 | B2 * | 6/2017 | Schmitz | A47C 7/54 |
| 9,687,079 | B1 * | 6/2017 | Grove | A47C 7/445 |
| 9,826,836 | B2 * | 11/2017 | Sander | A47C 7/445 |
| 9,826,839 | B2 * | 11/2017 | Battey | A47C 7/46 |
| 10,016,060 | B2 * | 7/2018 | Schmitz | A47C 7/44 |
| 10,016,061 | B2 * | 7/2018 | Brueske | A47C 7/462 |
| 10,111,525 | B2 * | 10/2018 | Sander | A47C 7/004 |
| 10,264,889 | B2 * | 4/2019 | Battey | A47C 7/004 |
| 10,299,595 | B2 * | 5/2019 | Diffrient | A47C 3/026 |
| 10,638,841 | B2 * | 5/2020 | Sander | A47C 1/02 |
| 10,791,842 | B2 * | 10/2020 | Peterson | A47C 3/12 |
| 10,820,706 | B2 * | 11/2020 | Schmitz | A47C 1/03277 |
| 10,842,281 | B2 * | 11/2020 | Battey | A47C 7/46 |
| 10,856,662 | B2 * | 12/2020 | Schmitz | A47C 7/14 |
| 10,932,571 | B2 * | 3/2021 | Kolberg | A47C 7/445 |
| 10,945,529 | B2 * | 3/2021 | O'Boyle | A47C 7/448 |
| 10,966,527 | B2 * | 4/2021 | Deevers | A47C 3/12 |
| 11,076,696 | B2 * | 8/2021 | Sander | A47C 1/02 |
| 11,229,294 | B2 * | 1/2022 | Battey | A47C 7/46 |
| 11,291,305 | B2 * | 4/2022 | Deevers | A47C 7/40 |
| 11,304,528 | B2 * | 4/2022 | Battey | A47C 3/20 |
| 11,330,905 | B2 * | 5/2022 | Schmitz | A47C 7/025 |
| 11,357,329 | B2 * | 6/2022 | Deevers | A47C 1/0307 |
| 11,464,341 | B2 * | 10/2022 | Battey | A47C 3/20 |
| 11,533,998 | B2 * | 12/2022 | Kinoshita | A47C 7/44 |
| 11,583,092 | B2 * | 2/2023 | Deevers | A47C 7/44 |
| 11,786,039 | B2 * | 10/2023 | Deevers | A47C 3/021 297/301.1 |
| 11,805,913 | B2 * | 11/2023 | Deevers | A47C 7/40 |
| 11,819,139 | B2 * | 11/2023 | Deevers | A47C 7/40 |
| 11,825,955 | B2 * | 11/2023 | Deevers | A47C 1/03277 |
| 12,004,660 | B2 * | 6/2024 | Deevers | A47C 7/46 |
| 12,161,232 | B2 * | 12/2024 | Deevers | A47C 7/44 |
| 12,207,737 | B2 * | 1/2025 | Deevers | A47C 1/03279 |
| 2002/0053822 | A1 * | 5/2002 | Ware | A47C 7/445 297/239 |
| 2007/0108818 | A1 * | 5/2007 | Ueda | A47C 7/445 297/285 |
| 2009/0261644 | A1 * | 10/2009 | Piretti | A47C 7/44 297/344.12 |
| 2010/0117422 | A1 * | 5/2010 | Ueda | A47C 7/4454 297/285 |

FOREIGN PATENT DOCUMENTS

| | | |
|---|---|---|
| KR | 200175104 Y1 | 3/2000 |
| WO | 91/03192 A1 | 3/1991 |

OTHER PUBLICATIONS

International Preliminary Report on Patentability for International patent application No. PCT/US2022/016799, filed Feb. 17, 2022, mailed Aug. 31, 2023.

* cited by examiner

CHAIR WITH DYNAMIC MOTION FEATURES

CROSS REFERENCE TO RELATED APPLICATION

This application is a national phase application of PCT Application No. PCT/US2022/016799, internationally filed on Feb. 17, 2022, which claims priority to Provisional Application No. 63/150,326, filed Feb. 17, 2021, which are herein incorporated by reference in their entireties.

FIELD

The present disclosure relates generally to seating apparatuses, systems, and methods. More specifically, the disclosure relates to flexing features for chair backrests, seats, and controls.

BACKGROUND

Chair manufacturers continually strive to improve the comfort, benefits, aesthetics, and manufacturability of the chairs they produce. Often, chairs have features, such as tilting or reclining backs and seats, to increase comfort, reduce or prevent injury, or otherwise enhance user experience.

Some examples of flexible chair backs can be found U.S. Pat. No. 10,172,465 to Machael et al., "Chair with Activated Back Flex," issued Jan. 8, 2019 and previously published as US 2016/0353896 on Dec. 8, 2016, relates to a chair back that includes a back support, a back frame, and at least one flex wing. The back support is substantially flexible and has a first side portion and a second side portion. The back frame is substantially rigid and has a first frame side and a second frame side. The flex wing is located between the first frame side and the first side portion of the back support, where the flex wing includes a front portion coupled to the first side portion of the back support, a back portion coupled to the first frame side, and a web portion interconnecting the front portion and the back portion of the flex wing. In use, the flex wing flexes during engagement of the back support by a user.

SUMMARY

According to one example ("Example 1"), a compliant chair backrest assembly includes a back frame having a first frame side, a second frame side, a lower portion and an upper portion that extends from the lower portion, the upper portion of the back frame being configured to engage with a back of a user and the lower portion including a first flexural member and a nexus, the first flexural member projecting in a lateral direction from the nexus such that the first flexural member defines a first lateral projection angle from the nexus, and the first flexural member defining a first lower contact surface and having a flexural rigidity. The assembly includes a reinforcement support including a first brace defining a first upper contact surface and having a flexural rigidity that is greater than the flexural rigidity of the first flexural member, the first brace being selectively engageable with the first flexural member such that the first lower contact surface of the first flexural member progressively engages with the first upper contact surface of the first brace when the first flexural member is deflected.

According to another example ("Example 2"), further to Example 1, an overall stiffness of the first flexural member increases in accordance with progressively increasing engagement of the first flexural member with the first brace.

According to another example ("Example 3"), further to Examples 1 or 2, the lower portion of the back frame further includes a second flexural member and the reinforcement support further includes a second brace selectively engageable with the second flexural member such that the second flexural member progressively engages with the second brace when the second flexural member is deflected.

According to another example ("Example 4"), further to Example 1, the first lower contact surface of the first flexural member is substantially planar.

According to another example ("Example 5"), further to any of Examples 1 to 4, the first lower contact surface of the first flexural member is defined by a plurality of spaced contact locations, and optionally, wherein the plurality of spaced apart locations define a discontinuous surface in a longitudinal direction along first lower contact surface.

According to another example ("Example 6"), further to any of Examples 1 to 5, the first upper contact surface of the first brace is non-planar.

According to another example ("Example 7"), further to any of Examples 1 to 6, at least a portion of the first upper contact surface of the first brace is curved in a longitudinal direction and, optionally at least a portion of the first upper contact surface of the first brace defines a radius of curvature in a longitudinal direction, and optionally, wherein at least a portion of the first upper contact surface defines a varying radius of curvature in a longitudinal direction.

According to another example ("Example 8"), further to any of Examples 1 to 7, at least a portion of the first brace has a longitudinal section that tapers in thickness and optionally, wherein a majority of the longitudinal section of the first brace tapers in thickness.

According to another example ("Example 9"), further to any of Examples 1 to 8, the first flexural member forms a first pocket, the first brace being at least partially receivable in the first pocket.

According to another example ("Example 10"), further to any of Examples 1 to 9, the first brace has a first end portion and a second end portion, the second end portion defining a free end and the first end portion being secured to the first flexural member.

According to another example ("Example 11"), further to any of Examples 1 to 10, a deflection force on the upper portion of the back frame along a rearward and lateral vector results in downward deflection of the flexural member against the first brace.

According to another example ("Example 12"), further to any of Examples 1 to 11, a deflection force on the upper portion of the back frame along a rearward vector results in downward deflection of the flexural member against the first brace.

According to another example ("Example 13"), further to any of Examples 1 to 12, a deflection force positioned on a vertical centerline of the upper portion of the back frame along a vector that is oriented 20 degrees or less from perpendicular to the vertical centerline and to the upper portion of the back frame, results in a substantially linear load vs. rearward deflection distance response measured at an upper corner of the upper portion.

According to another example ("Example 14"), further to any of Examples 1 to 13, a deflection force positioned laterally offset from a vertical centerline of the upper back portion at the first frame side and along a vector that is oriented 20 degrees or less from perpendicular to the vertical centerline and angled laterally inward from the upper portion toward the vertical centerline, results in a substantially linear load vs. rearward deflection distance response measured at an upper corner of the upper portion.

According to another example ("Example 15"), further to any of Examples 1 to 14, a deflection force positioned on a vertical centerline of the upper portion of the back frame along a vector that is oriented 20 degrees or less from perpendicular to the vertical centerline and to the upper portion of the back frame, results in a substantially linear load vs. lateral deflection distance response measured at an upper corner of the upper portion.

According to another example ("Example 16"), further to any of Examples 1 to 15, a deflection force positioned laterally offset from a vertical centerline of the upper back portion at the first frame side and along a vector that is oriented 20 degrees or less from perpendicular to the vertical centerline and angled laterally inward from the upper portion toward the vertical centerline, results in a substantially asymptotic load vs. lateral deflection distance response measured at an upper corner of the upper portion.

According to another example ("Example 17"), further to any of Examples 1 to 16, the upper portion of the back frame forms a central opening, the compliant chair backrest assembly further comprising a mesh back coupled across the central opening of the upper portion of the back frame.

According to another example ("Example 18"), further to Example 17, the compliant chair backrest assembly further includes an inner frame, the inner frame being coupled to the upper portion of the back frame to secure the mesh back to the upper portion of the back frame.

According to another example ("Example 19"), a chair includes the backrest assembly of any of Examples 1 to 18.

According to another example ("Example 20"), a method of making the backrest assembly of any of Examples 1 to 19.

The foregoing Examples are just that, and should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Definitions and Terminology

Figure 1:
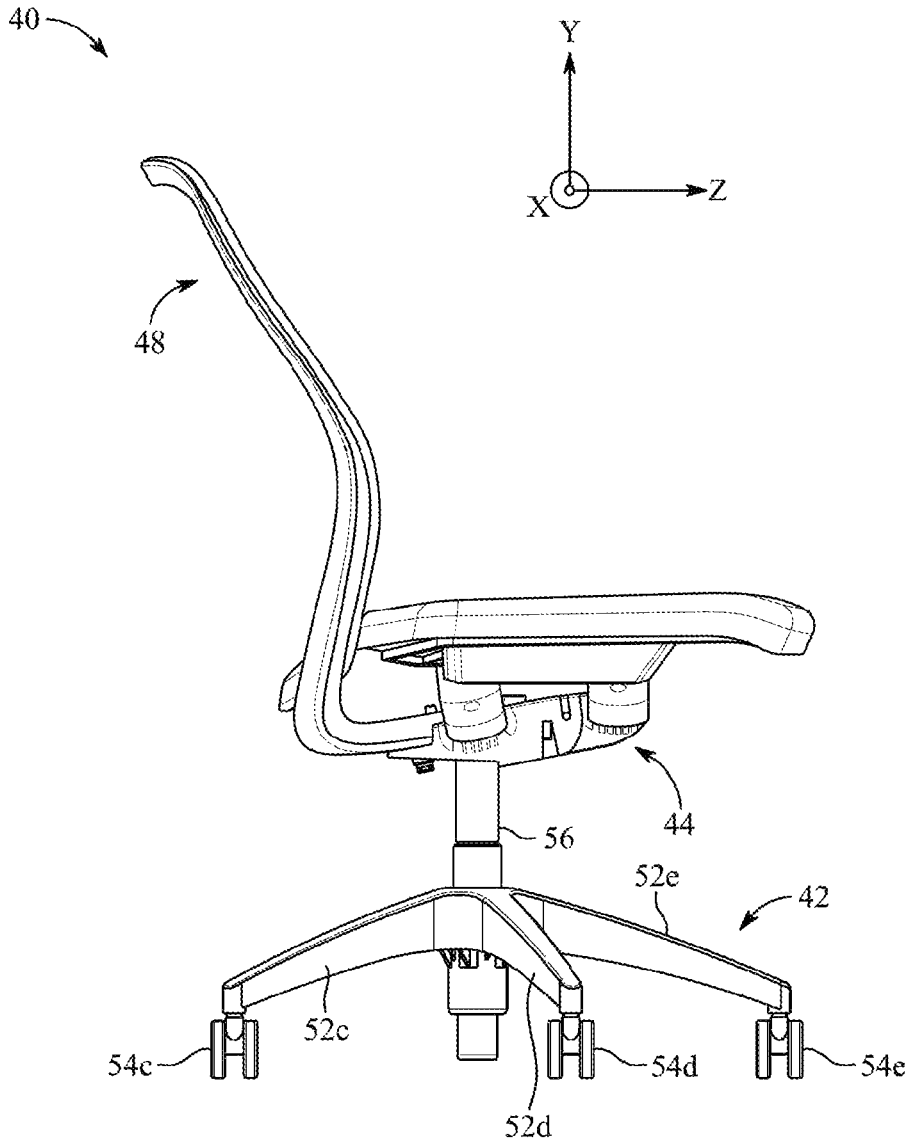
FIG. 1 is a side view of a chair, according to some embodiments.

This disclosure is not meant to be read in a restrictive manner. For example, the terminology used in the application should be read broadly in the context of the meaning those in the field would attribute such terminology.

With respect to terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error, differences in measurement and/or manufacturing equipment calibration, human error in reading and/or setting measurements, minor adjustments made to optimize performance and/or structural parameters in view of differences in measurements associated with other components, particular implementation scenarios, imprecise adjustment and/or manipulation of objects by a person or machine, and/or the like, for example. In the event it is determined that individuals having ordinary skill in the relevant arts would not readily ascertain values for such reasonably small differences, the terms "about" and "approximately" can be understood to mean plus or minus 10% of the stated value.

With respect to coordinate systems, the X-axis generally corresponds to a horizontal direction, the Y-axis generally corresponds to a vertical direction, and the Z-plane generally corresponds to a forward, or anterior direction. Thus, a plane that intersects a superior-inferior, or vertical axis and a anterior-posterior, or front-to-back axis, is the Y-Z plane, and so forth.

With respect to ranges, use of the term "between" is meant to disclose and encompass the end points of the recited ranges, as well as any discrete value within the recited range.

DESCRIPTION OF VARIOUS EMBODIMENTS

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

FIG. 1 illustrates a chair 40, according to some embodiments. As shown, the chair 40 includes a base 42, a control 44, a seat 46, and a compliant chair backrest assembly 48, or backrest 48 in brief. The chair may also include armrests or other additional or alternative features (not shown). For example, rather than the base 42 shown, the chair 40 may include legs (e.g., three or four).

As shown, the base 42 supports the chair 40, including the control 44, the seat 46, and the backrest 48, on a surface, such as the floor of an office building. The control 44 is connected to the base 42, and the seat 46 and the backrest 48 are connected to and supported by the control 44. In some embodiments, armrests are attached to the backrest 48. In some embodiments, armrests (not shown) are attached to the control 44.

As shown, the base 42 includes leg supports 52*a*-52*e* that support the chair 40 on the surface, where each of the leg supports 52*a*-52*e* includes a corresponding wheel 54*a*-54*e* for rolling the chair 40 on the surface. In some embodiments, the base 42 includes greater or fewer than five leg supports 52*a*-52*e*. And rather than rollers, one or more of the leg supports 52*a*-52*e* can include a foot, such that the chair 40 does not roll, but simply rests on a surface.

In some embodiments, the control 44 is rotatably connected to the base 42, such that the seat 46 and the backrest 48 swivel on the base 42 via the control 44. In some embodiments, the control 44 includes a lever arm (not shown) for adjusting the seat height or other adjustable aspects of the chair 40. In general terms, the seat 46 supports the posterior of the user while the backrest 48 supports the back of the user, though more generally each of these features—the seat 46 and the backrest 48—serve to support the body of the user. As described in greater detail, the backrest 48 flexes, bends, or is otherwise compliant to accommodate user seating positions and the body of the user in those user seating positions.

Figure 2:
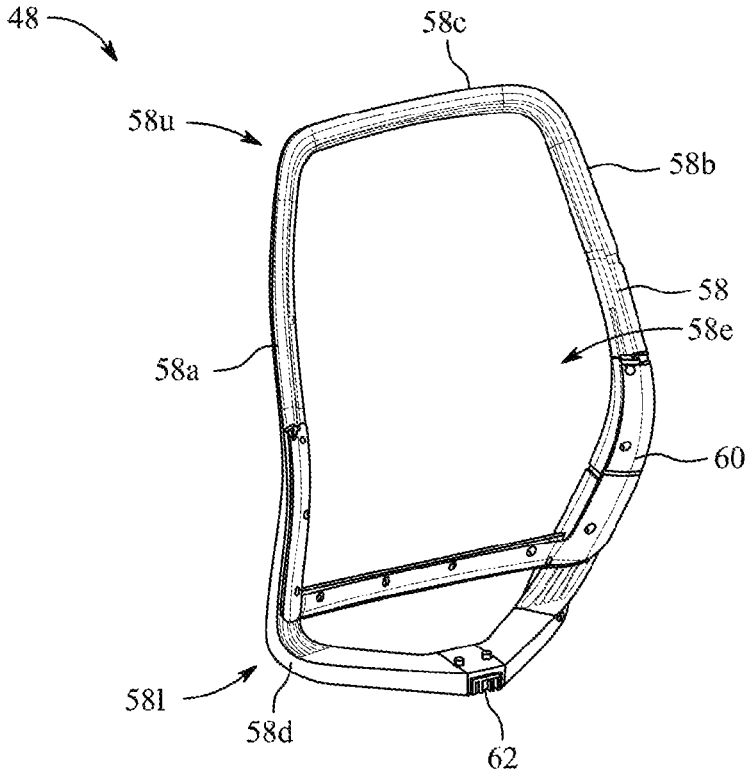
FIG. 2 is an isometric view of a backrest back frame of the chair of FIG. 1, according to some embodiments.
Figure 3:
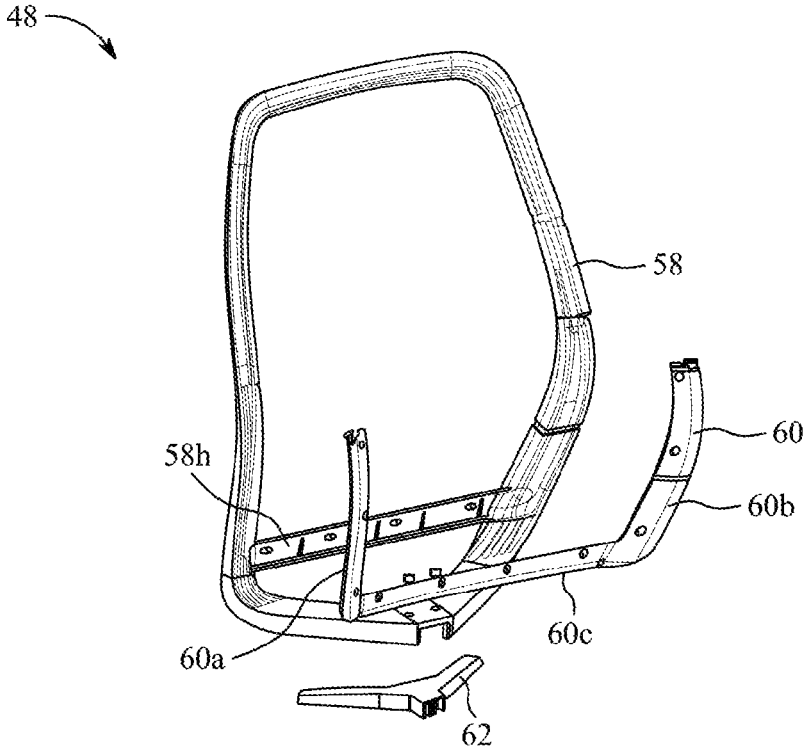
FIG. 3 is a disassembled view of the back frame and reinforcement support of FIG. 2, according to some embodiments.

FIG. 2 shows the backrest 48 from an isometric view in a first, assembled state and FIG. 3 shows the backrest 48 in a disassembled state. As shown, the backrest 48 includes a back frame 58, an inner frame 60, and a reinforcement support 62. In general terms, the back frame 58 and the inner frame 60 may be coupled to retain a mesh material 64 (see, e.g., FIGS. 13 and 14) for supporting the user. The reinforcement support 62 may be coupled to the back frame 58 to provide a desired degree of compliance, or rigidity, to the backrest 48 as will be subsequently described.

In some embodiments, the back frame 58 is secured directly to the base 42. As shown, however, the back frame 58 is secured to the control 44. The back frame 58 includes a first side 58*a* (also described as a first upright), a second side 58*b* (also described as a second upright), a top 58*c* and a bottom 58*d*. In some embodiments, the back frame 58 is generally O-shaped defining a central opening 58*e*. A variety of other shapes may be incorporated into the back frame 58, including Y-shaped, X-shaped, U-shaped, H-shaped or other configurations. The back frame 58 defines an upper portion 58*u* and a lower portion 581. And, as shown, the back frame 58 includes an interconnecting member 58*h* (also described as a cross-bar) extending generally horizontally between the first and second sides 58*a*, 58*b*. For reference, the interconnecting member 58*h* generally corresponds to, and thus delineates, a boundary between the upper portion 58*u* and the lower portion 581, though the interconnecting member 58*h* may be at any position or there may be more than one interconnecting member 58*h*, for example. As shown, the back frame 58 is a closed loop frame (e.g., rectangular-, circular-, or oval-shaped frame).

In some embodiments, the back frame 58 (e.g., the upper portion 58*u*) is a shell, such as a solid shell or a rigid shell, which extends from the first frame side 58*a* to the second frame side 58*b*. The upper portion 58*u* extends from the lower portion 581. In terms of operation, the upper portion 58*u* is configured to engage with a back of a user (not shown). The upper portion 58*u* may have some degree of flex, or compliance, and may deform to some extent under the weight of a user (e.g., during reclining, twisting, or other movement). For example, the back frame 58 may be formed from a polymeric material, such as PA6 GF 20%. The back frame 58 in the upper portion 58*u* may be formed from a material tending to exhibit a flexural modulus of about 870 kpsi, for example, although a variety of values are contemplated, and a variety of factors may influence flexural rigidity of the back frame 58.

The first and second frame sides 58*a*, 58*b* can be modified in thickness, width, and cross-section (e.g., area moment of inertia) and material (e.g., flexural modulus) to vary the bending stiffness, flexural rigidity, and overall flexibility of the upper portion 58*u*. Additionally or alternatively, orientation angles of the first and second frame sides 58*a*, 58*b* as measured with respect to the X-Y plane may be selected to alter flexibility of the back frame. In some examples, the first frame side 58*a* defines an orientation angle of about 15 degrees, although a variety of values are contemplated, including from 0 degrees to 60 degrees, for example.

Figure 4:
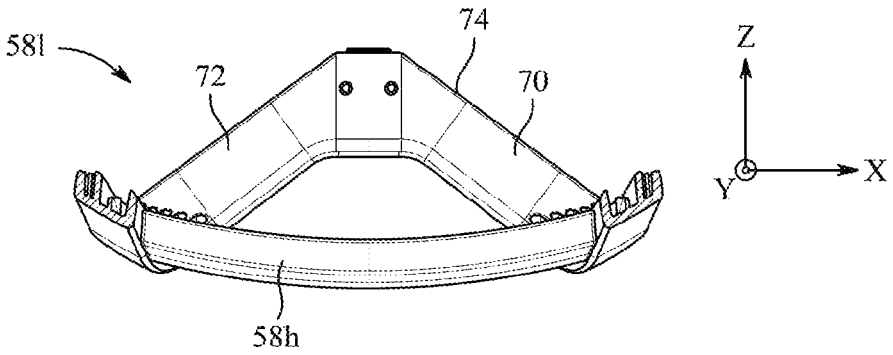
FIGS. 4 and 5 are sectional views of the back frame and reinforcement support of FIG. 2, according to some embodiments.

FIG. 4 is a partial section in the X-Z plane showing a plan view of the lower portion 58*u* and interconnecting member 58*h* with the upper portion 58*u* largely removed from view. The thickness, width, cross-section, and material, for example, of the interconnecting member 58*h* can be selected to alter the flexibility of the back frame 58. As shown in FIG. 4, the interconnecting member 58*h* is substantially arcuate, extending through an angle from eighty (80) to one-hundred thirty (130) degrees in the X-Z plane as measured relative to the Z-axis, for example. As a more specific example, the interconnecting member may extend through an arc of about 106.6 degrees, although to adjust the system performance the angle may be increased or decreased by twenty (20) degrees, for example, as desired. Thus, the interconnecting member may extend through an arc of between 86.6 and 126.6 degrees, for example.

Figure 5:
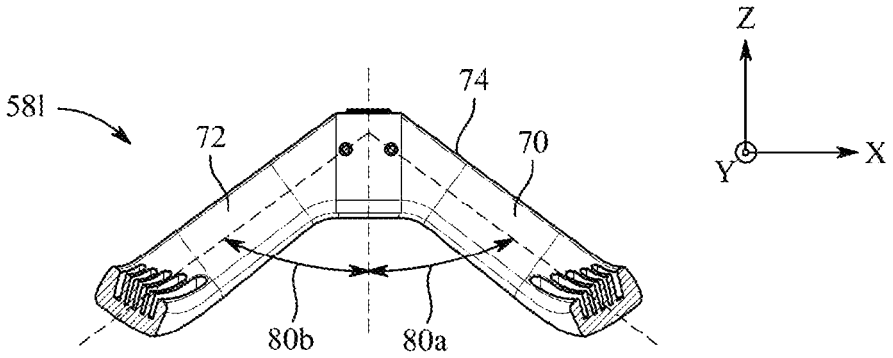

FIG. 5 is a plan view of the lower portion 581 at a cross-section taken through just below the interconnecting member 58*h* such that the interconnecting member 58*h* and upper portion 58*u* are removed from view. The lower portion 581 of the back frame 58 includes a first flexural member 70, a second flexural member 72, and a nexus 74. The first flexural member 70 projects in a lateral direction from the nexus 74 such that the first flexural member 70 defines a first lateral projection angle 80*a* from the nexus 74. The first flexural member 70 generally exhibits a flexural or bending rigidity in the vertical, Y-direction. The area moment of inertia, flexural modulus of the material forming the first flexural member 70, and other factors may be selected to modify flexural or bending rigidity.

As shown, in some embodiments, the first lateral projection angle 80*a* is from forty (40) to sixty-five (65) degrees in the X-Z plane as measured relative to the Z-axis. As one more specific example, the first lateral projection angle 80*a* may be 53.3 degrees, although to adjust the system performance the angle may be increased or decreased by twenty (20) degrees, or ten (10) degrees, for example, as desired.

Thus, the first lateral projection angle 80*a* may range between 43.3 and 63.3 degrees, for example.

The first flexural member 70 may also project in a vertical direction from the nexus such that the first flexural member 70 defines a first vertical projection angle from the nexus. However, in the example of the Figures, the first flexural member 70 is shown to exhibit a vertical projection angle of "zero". In other words, the vector along which the first flexural member 70 extends is substantially horizontal, and does not include a vertical component (or has a vertical component of "zero" corresponding to the first vertical projection angle). The vector along which the first flexural member 70 extends also exhibits a horizontal component (corresponding to the first lateral projection angle 80*a*). In some examples, the first vertical projection angle may be zero, range between −15 and 15 degrees, for example, although a variety of vertical projection angles are contemplated.

In some examples, a width of the first flexural member 70 and/or a thickness of the first flexural member 70 may be modified in order to adjust the flexibility thereof. The cross-section can also be modified (e.g., material removed or added) in order to alter flexibility. Material selection also plays a role in flexibility. In some examples, the first flexural member 70 is formed of PA6 GF 20%, although a variety of materials are contemplated.

Figure 6:
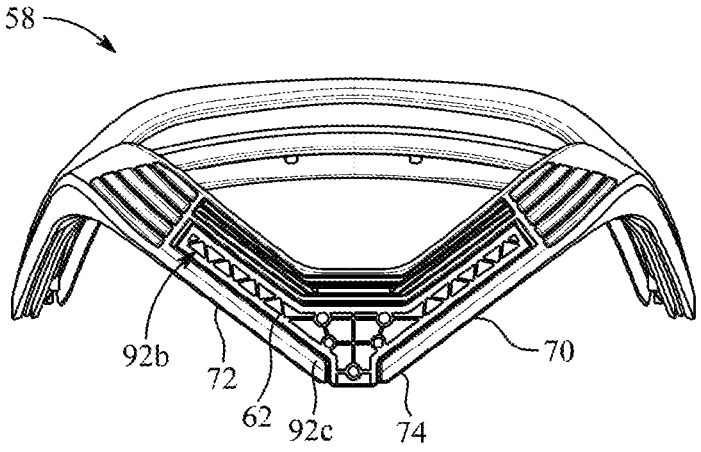
FIG. 6 is a bottom view of the back frame and reinforcement support of FIG. 2, according to some embodiments.
Figure 7:
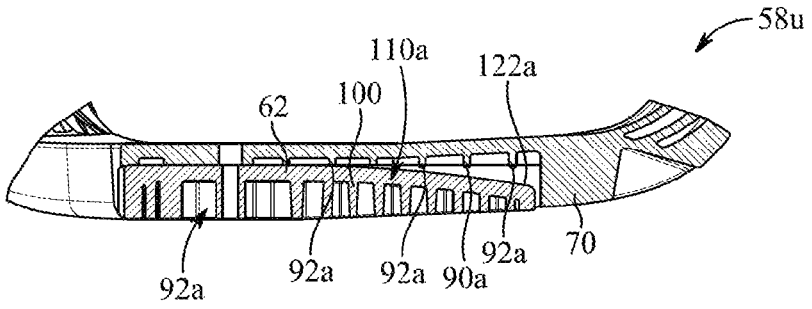
FIG. 7 is a sectional view of the back frame and reinforcement support of FIG. 2, according to some embodiments.

FIG. 6 is a bottom view of the back frame 58 and reinforcement support 62 and FIG. 7 is a longitudinal section of the lower portion 58*u* taken along the first flexural member 70, according to some examples. As shown the first flexural member 70 defines a first lower contact surface 90*a*. The first lower contact surface 90*a* is substantially planar, as shown, and is defined by a plurality of spaced contact locations 91 (e.g., bumps, ridges, protrusions, or the like) generally extending to a common plane. In other embodiments, the first lower contact surface 90*a* is non-planar (e.g., curved). As shown in FIG. 6 and FIG. 7, the first flexural member 70 forms a first pocket 92*a* configured to at least partially receive the reinforcement support 62.

As shown, the second flexural member 72 can be a mirror image of the first flexural member 70, formed of the same materials of similar construction, including substantially the same features as those described above. As such, components of the second flexural member 72 will be called out in the figures and referred to herein using the same reference numbers as the first flexural member 70, followed by a "b." Thus, the second flexural member 72 defines a second lateral projection angle 80*b*, a second vertical projection angle (e.g., zero degrees), a second lower contact surface (not shown) and a second pocket 92*b* configured to at least partially receive the reinforcement support 62. Each of the foregoing may include features similar to those described in association with the first flexural member 70.

In some examples, the nexus 74 is acts as a substantially Y- or V-shaped junction between the first and second flexural members 70, 72. The nexus 74 optionally has third lower contact surface 90*c* for engaging with the reinforcement support 62, and a third pocket 92*c* configured to at least partially receive the reinforcement support 62. As indicated in FIG. 6, the first and second pockets 92*a*, 92*b* of the first and second flexural members 70, 72 are interconnected by the third pocket 92*c* to define a single, continuous pocket 92 configured to at least partially receive the reinforcement support 62.

As shown in FIG. 3, the inner frame 60 is configured to be coupled to the back frame 58 and may be implemented to help retain the mesh material 64 (FIG. 13) to the back frame 58. As shown, the inner frame 60 is U-shaped, having two legs 60*a*, 60*b* and a base 60*c*. The two legs 60*a*, 60*b* attach to the first and second sides 58*a*, 58*b* of the back frame 58. In particular, the base 60*c* optionally attaches to the interconnecting member 58*h*, as shown. The mesh material 64 may be coupled across the central opening of the upper portion 58*u* of the back frame 58. The inner frame 60 may be snap-fit, bolted, screwed, heat welded, or otherwise attached to the back frame 58.

Figure 8:
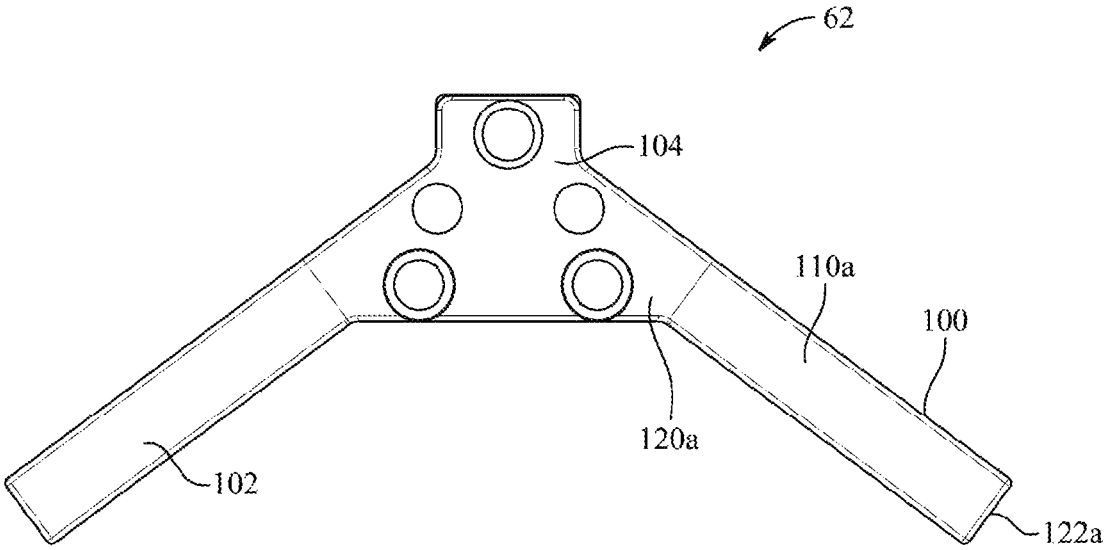
FIG. 8 is a plan view of the reinforcement support, according to some embodiments.

FIG. 8 shows the reinforcement support 62 from a plan view. As shown in FIG. 6 (bottom) and FIG. 7 (sectional view) and FIG. 8, the reinforcement support is substantially Y-shaped. The reinforcement support 62 includes a first brace 100, a second brace 102, and a trunk 104 as shown in FIG. 8. The first and second flexural members 70, 72 are configured to flex against the first and second braces 100, 102 during flexing of the back frame 58. In some examples, the nexus 74 may flex against the trunk 104 to some extent. Regardless, in general terms, the overall stiffness, or operative stiffness, of the first and second flexural members 70, 72 increases in accordance with an increase in contact-area between the flexural members 70, 72 and the reinforcement support 62, and specifically the first and second braces 100, 102.

In various examples, the reinforcement support 62 is generally stiffer than the first and second flexural members 70, 72 and the nexus 74. For example, the reinforcement support 62 may be formed of PA6 GF 50% or other material have a relatively high flexural modulus. Thus, in various examples, the first brace 100 has a flexural modulus that is greater than the flexural modulus of the first flexural member 70. More generally, the first brace 100 may be configured to have a flexural rigidity (e.g., flexural modulus and/or area moment of inertia) that is greater than the flexural rigidity (e.g., flexural modulus and/or area moment of inertia) of the first flexural member 70.

As shown, the first brace 100 defines a first upper contact surface 110*a* for progressively engaging with the first lower contact surface 90*a*. As shown in FIG. 7, the first upper contact surface 110*a* of the first brace 100 is non-planar. In particular, the first upper contact surface 110*a* of the first brace 100 is curved, or arcuate in extension, although a variety of shapes are contemplated. As shown in the sectional view of FIG. 7, the first brace 100 has a longitudinal section that tapers in thickness. The first brace 100 extends a length between a first end portion 120*a* and a second end portion 122*a*, the second end portion 122*a* defining a free end that is free to flex relative to the first flexural member 70 and the first end portion 120*a* being secured relative to the first flexural member 70 in the fashion of a cantilever (whether directly or through the trunk 104.

The first brace 100 projects in a lateral direction from the trunk 104 such that the first brace 100 defines a first lateral projection angle from the trunk 104, which may match the first lateral projection angle 80*a* of the first flexural member 70. The first brace 100 may also project in a vertical direction from the trunk 104 such that the first brace 100 defines a first vertical projection angle from the trunk 104, which may match the first vertical projection angle 82*a* of the first flexural member 70 (e.g., zero degrees).

The first brace 100 generally defines a flexural or bending rigidity in the vertical, Y-direction. In some embodiments, the flexural rigidity of the first brace 100 is selected by varying material, a width of the first brace 100 and/or a thickness of the first brace 100, and other characteristics in order to adjust the flexibility thereof. For example, the cross-section and projection angles can also be modified (e.g., material removed or added) in order to alter flexibility.

As shown, the second brace 102 can be a mirror image of the first brace 100, formed of the same materials of similar construction, including substantially the same features as those described above. As such, components of the second brace 102 will be called out in the figures and referred to herein using the same reference numbers as the first brace 100, followed by a "b." Thus, the second brace 102 defines a second lateral projection angle and a second vertical projection angle from the trunk 104, a second upper contact surface 110*b*, and extends a length between a first end portion 120*b* and a second end portion 122*b*, the first end portion 120*b* being secured relative to the second flexural member 72 in the fashion of a cantilever (whether directly or through the trunk 104). Each of the foregoing may include features similar to those described in association with the first brace 100.

In some examples, the trunk 104 acts as a substantially Y- or V-shaped junction between the first and second braces 100, 102. The trunk 104 optionally has third upper contact surface 110*c* for engaging with the nexus 74, and is configured to at least partially received in the pocket 92*c* of the nexus 74, with the first brace 100 received in the first pocket 92*a* of the first flexural member 70 and the second brace 102 received in the second pocket 92*b* of the second flexural member 72.

Figure 9:
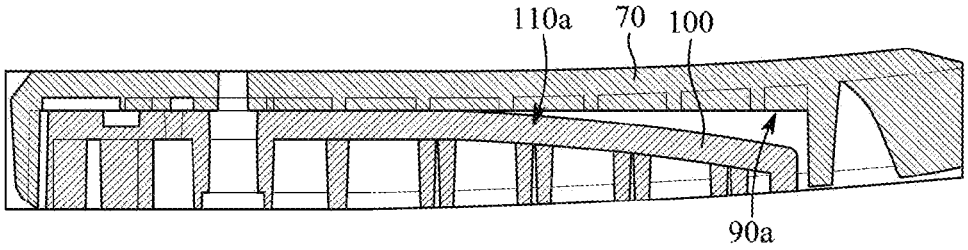
FIGS. 9-12 are sectional views of back frames and reinforcement supports, according to some embodiments.
Figure 10:
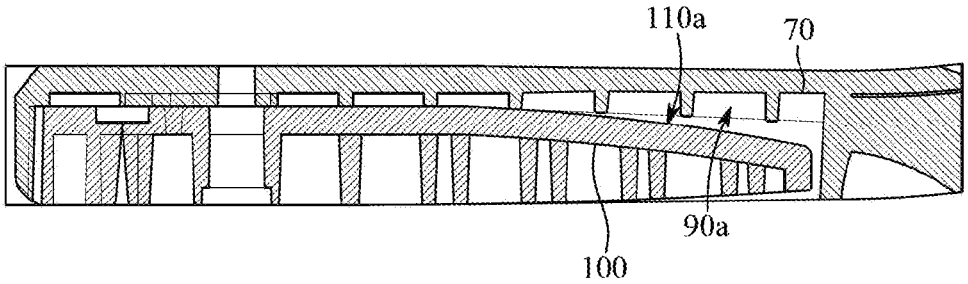

FIGS. 9 and 10 are illustrative of the first flexural member 70 deflecting to engage with the first brace 100 following imposition of a backward (twisting and/or tilting) force on the back frame 58 to load the first flexural member 70. FIG. 9 shows the arrangement pre-loading and FIG. 10 shows the arrangement in a loaded (e.g., partially loaded) condition. As shown, the first brace 100 is selectively engageable with the first flexural member 70 such that the first lower contact surface 90*a* of the first flexural member 70 progressively engages with the first upper contact surface 110*a* of the first brace when the first flexural member is deflected. In this manner, an overall stiffness of the first flexural member 70 increases in accordance with progressively increasing engagement of the first flexural member 70 with the first brace 100. For example, a deflection force on the upper portion 58*u* of the back frame 58 along a rearward and lateral vector results in downward deflection of the first flexural member 70 against the first brace 100. And, a deflection force on the upper portion 58*u* of the back frame 58 along a rearward vector results in downward deflection of the flexural member 70 against the first brace 100.

Though not shown, the second brace 102 and the second flexural member undergo a similar deformation sequence. In particular, the second brace 102 is selectively engageable with the second flexural member 72 such that the second flexural member 72 progressively engages with the second brace 102 when the second flexural member 72 is deflected upon loading of the back frame 58 (e.g., during twisting and/or tiling).

Figure 11:
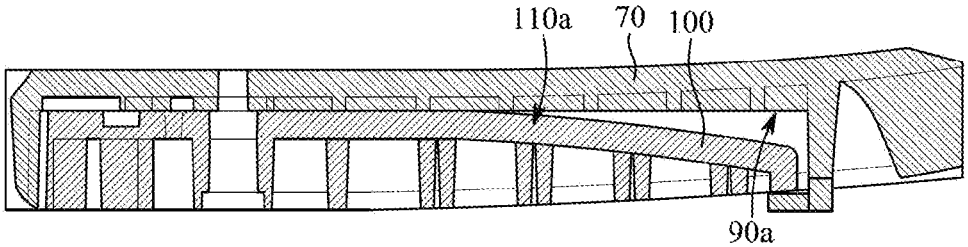
Figure 12:
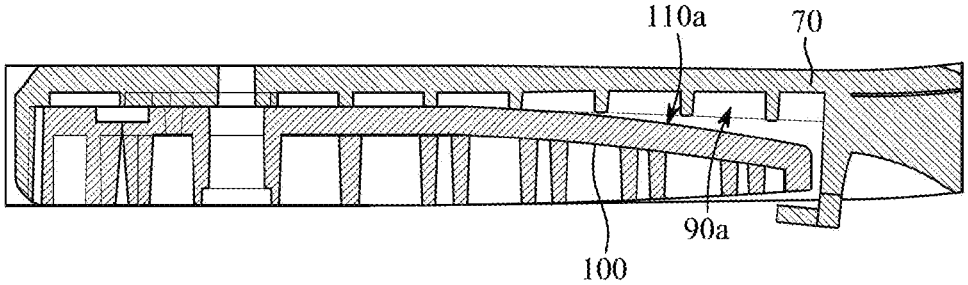

FIGS. 11 and 12 show a design modification where the first flexural member 70 (and, by extension, the second flexural member 72) includes a latch or hook to help prevent lifting of the first flexural member 70 to a hyper-extended position flexed away from the first brace 100. This can be particularly helpful, for example, when a person pushes forward on the back frame 58 (e.g., when rolling chair 40). Similar principals would apply to the second flexural member 72.

Figure 13:
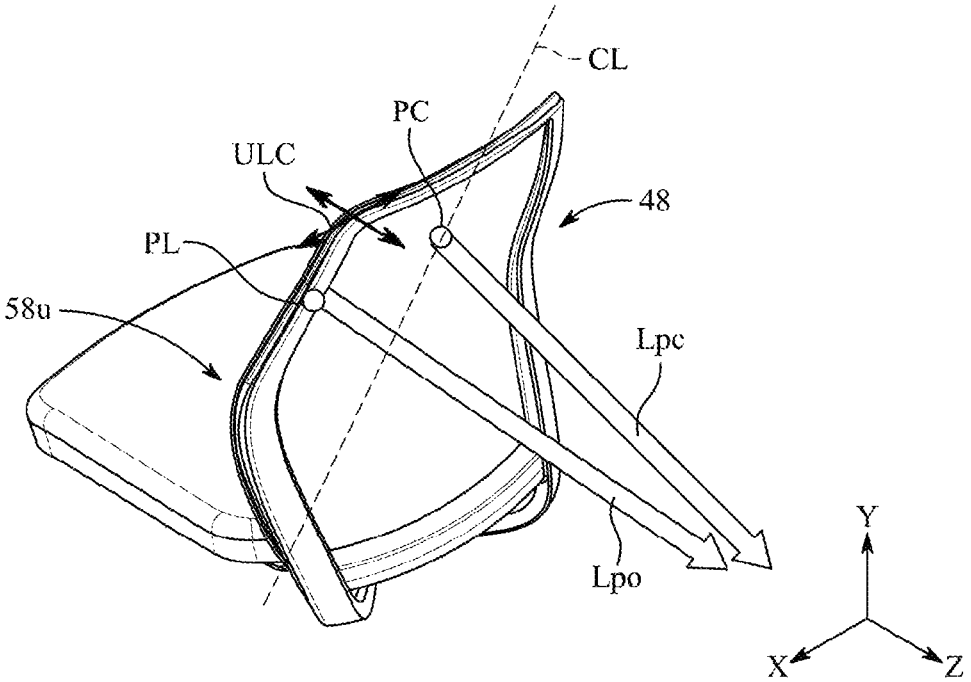
FIG. 13 is an isometric visualization of first and second loads applied for chair performance assessment, according to some embodiments.
Figure 14:
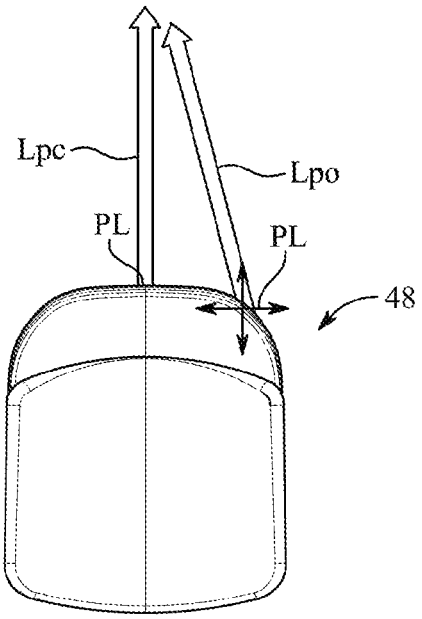
FIG. 14 is a top-down visualization of the first and second loads of FIG. 13, according to some embodiments.
Figure 15:
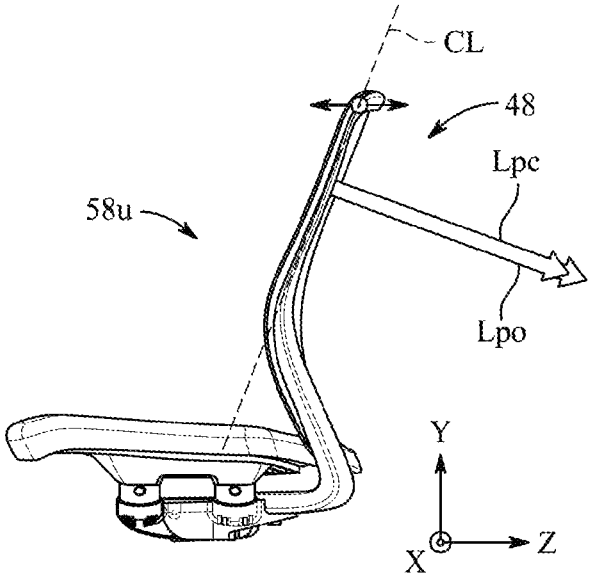
FIG. 15 is a side visualization of the first and second loads of FIG. 13.
Figure 16:
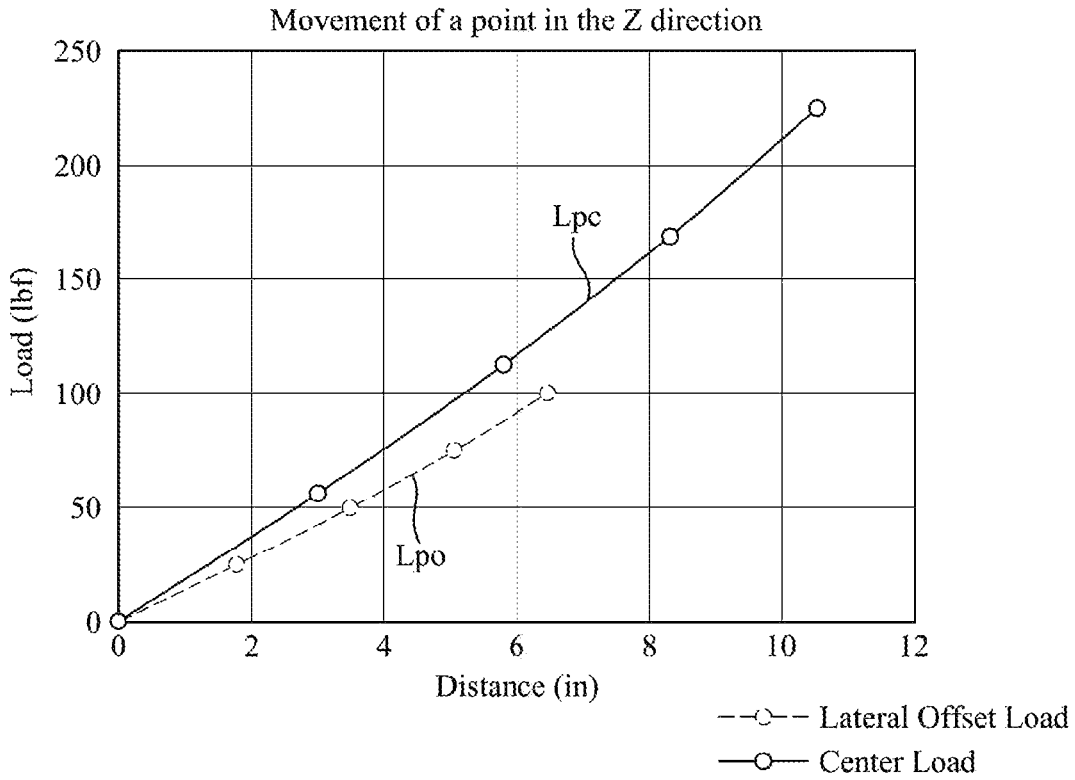
FIG. 16 shows a rear load vs. deflection response for offset- and centrally-applied loads.

FIG. 13 is an isometric visualization of first and second loads applied for chair performance assessment, according to some embodiments, and FIG. 14 is a top-down visualization of the first and second loads of FIG. 13, according to some embodiments. FIG. 15 is a side visualization of the first and second loads of FIG. 13. And, FIG. 16 shows a rear load vs. deflection response for laterally offset- and centrally-applied loads.

FIG. 13 is representative of two load placements consistent with two loading conditions for assessing chair responses to loading. Chair response, and in particular response of the backrest 48 to loading can be characterized in a variety of ways. As shown in FIG. 13, two different testing load types, a central rearward load Lpc and laterally offset rearward load Lpo may be applied. In the example of a laterally offset rearward load, response of the backrest 48 may be evaluated by placing a laterally offset rearward load Lpo at a laterally offset load point PL on the upper portion 58*u* of the back frame 58 along the first side 58*a* of the back frame 58. This can be termed "asymmetric" loading or "offset lateral" loading as the load is not located along a vertical centerline CL of the backrest 48. Another load, a central rearward load Lpc is placed at a central location along the vertical centerline CL of the back frame 58. This can be termed "central" loading, or central rearward loading.

As shown, each of the central rearward load Lpc and the laterally offset rearward load Lpo may be substantially perpendicular to the vertical centerline CL of the backrest 48 measured at the upper portion 58*u* of the back frame 58 (e.g., from 70 degrees to 110 degrees relative to the vertical centerline CL). Thus, each of the central rearward load Lpc and the laterally offset rearward load Lpo may be 20 degrees or less from perpendicular to the vertical centerline. As shown, the upper portion 58*u* (and thus the vertical centerline CL) may be canted, or angled relative to the Y-axis (e.g., at an angle of 5 degrees to 45 degrees offset from vertical). As shown, the central rearward load Lpc extends generally in the Y-Z plane. In turn, the laterally offset rearward load Lpo is angled relative to the Y-Zplane, and more specifically laterally inward from the upper portion 58*u* toward the vertical centerline CL.

In various examples, the resultant deflection under various loads is measured along a purely posterior, or rearward vector along the Z-axis (termed, "rear deflection testing" in our example). Resultant deflection of the back frame 58 under the rear deflection testing may be assessed at an upper, lateral corner ULC of the back frame 58 that is proximate the top 58*c* of the back frame 58 on the first side 58*a* of the back frame 58. In such cases, the laterally offset rearward load Lpo may cause the first flexural member 70 to tend to exhibit a relatively higher downward deflection response than the second flexural member 72.

As a result of the progressive engagement of the first flexural member 70 with the first brace 100 and, optionally, also the second flexural member 72 with the second brace 102, the rearward deflection at the upper, lateral corner ULC of the upper portion 58*u* of the back frame 58 along the Z-axis results in a substantially linear load vs. rearward deflection distance response at the upper, lateral corner ULC of the upper portion 58*u*. This relationship is shown in FIG. 16, which depicts rear deflection distance against different load values for the laterally offset rearward load Lpo, as well as the central rearward load Lpc condition. Similarly to the laterally offset rearward load Lpo condition, the central rearward load Lpc conditions results in a rearward deflection at the upper, lateral corner ULC of the upper portion 58*u* of the back frame 58 along the Z-axis having a substantially linear load vs. rearward deflection distance response at the upper, lateral corner ULC of the upper portion 58*u*.

In various examples, the resultant deflection under various loads is measured along a purely lateral, or sideways vector along the X-axis, or along the width of the chair, (termed, "lateral deflection testing" herein). This lateral deflection testing can help demonstrate the resistance of the back frame 48 to collapse or deflect inwardly during application of the central rearward load Lpc. As shown in FIG. 16, while load is applied on the center of the backrest 48 at the upper portion 58*u*, there is very little movement in the lateral direction. In other words, the configuration has good lateral stability with a substantially linear load vs. lateral deflection distance response measured at an upper corner UC of the upper portion 58*u*. In turn, when the laterally offset rearward load Lpo is applied, there is some lateral deflection in the lower load ranges which quickly taper off such that there is a substantially asymptotic load vs. lateral deflection distance response measured at an upper corner UC of the upper portion 58*u*. This too shows good overall stability of the backrest 48.

Figure 17:
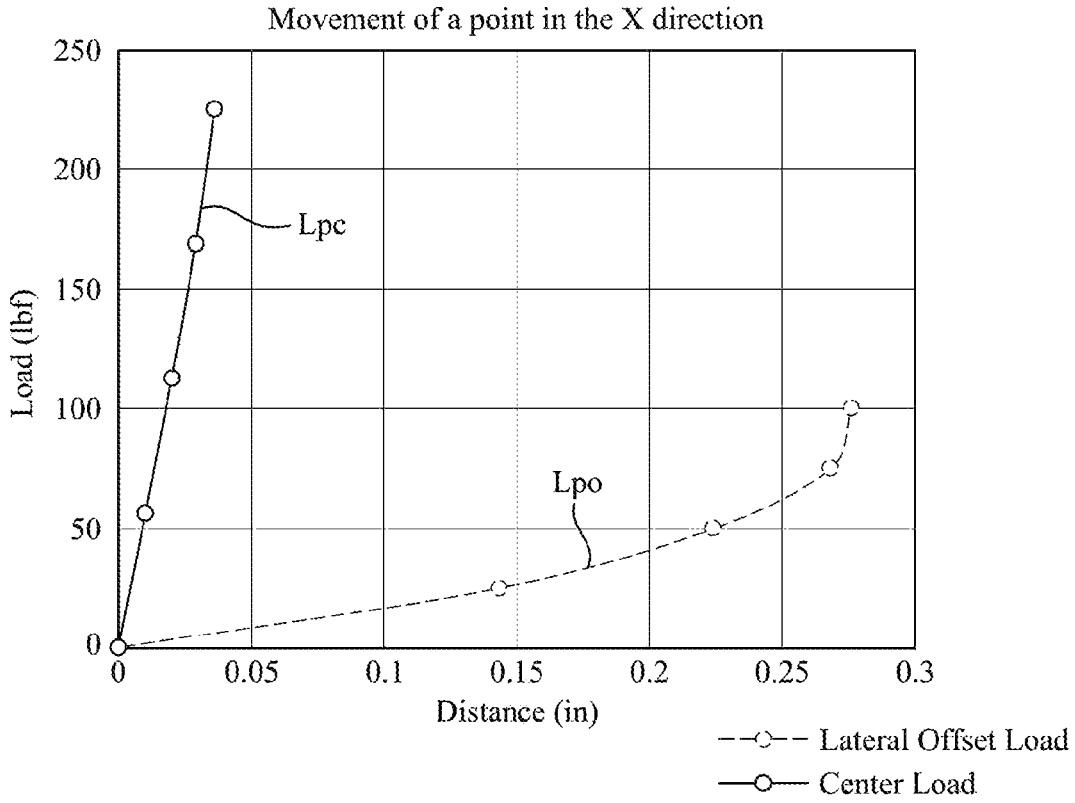
FIG. 17 shows a lateral load vs. deflection response for offset- and centrally-applied loads.

The above testing reveals a variety of advantages of the above-described arrangements. The graph of FIG. 16 indicates that as load is applied a given point on the backrest 48 it will move a comparable distance in the Z direction regardless of whether the applied load has a lateral component of force. This helps demonstrate the back is supportive for most user positions and movements. The graph of FIG. 17 indicates that as load is applied a given point's movement in the X direction will differ significantly in accordance with the magnitude of the lateral component of the load. Furthermore the deflection in the X direction shows asymptotic behavior and eventually will cease movement in the X direction. This asymptote occurs prior to substantial user-perceived instability. This allows dynamic and ergonomic movement without sacrificing user support throughout the motion.

Although such advantages may be achieved, additional or alternative advantages may also be realized by the application of the design concepts addressed herein. In other words, the above-noted advantages are not meant to be taken in a limiting sense in considering the full scope of the concepts provided herein.

The concepts described above also includes methods of using and assembling chairs and backrests according to the foregoing examples. In some embodiments, a method of making a chair includes assembling a backrest by coupling a reinforcement support to a back frame in the manner described above. The backrest may be assembled to a chair controller, and base, for example.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A compliant chair backrest assembly comprising:

a back frame having a first frame side, a second frame side, a lower portion and an upper portion that extends from the lower portion, the upper portion of the back frame being configured to engage with a back of a user and the lower portion including a first flexural member and a nexus, the first flexural member projecting in a lateral direction from the nexus such that the first flexural member defines a first lateral projection angle from the nexus, and the first flexural member defining a first lower contact surface and having a flexural rigidity; and a reinforcement support including a first brace defining a first upper contact surface and having a flexural rigidity that is greater than the flexural rigidity of the first flexural member, the first upper contact surface of the first brace being non-planar, and the first brace being selectively engageable with the first flexural member such that the first lower contact surface of the first flexural member progressively engages with the first upper contact surface of the first brace when the first flexural member is deflected.

2. The compliant chair backrest assembly of claim 1, wherein an overall stiffness of the first flexural member increases in accordance with progressively increasing engagement of the first flexural member with the first brace.

3. The compliant chair backrest assembly of claim 1, wherein the first lower contact surface of the first flexural member is substantially planar.

4. The compliant chair backrest assembly of claim 1, wherein at least a portion of the first upper contact surface of the first brace is curved in a longitudinal direction and, optionally at least a portion of the first upper contact surface of the first brace defines a radius of curvature in a longitudinal direction, and optionally, wherein at least a portion of the first upper contact surface defines a varying radius of curvature in a longitudinal direction.

5. The compliant chair backrest assembly of claim 1, wherein at least a portion of the first brace has a longitudinal section that tapers in thickness, and optionally, wherein a majority of the longitudinal section of the first brace tapers in thickness.

6. The compliant chair backrest assembly of claim 1, wherein the first brace has a first end portion and a second end portion, the second end portion defining a free end and the first end portion being secured to the first flexural member.

7. The compliant chair backrest assembly of claim 1, wherein a deflection force on the upper portion of the back frame along a rearward and lateral vector results in downward deflection of the flexural member against the first brace.

8. The compliant chair backrest assembly of claim 1, wherein a deflection force on the upper portion of the back frame along a rearward vector results in downward deflection of the flexural member against the first brace.

9. The compliant chair backrest assembly of claim 1, wherein a deflection force positioned on a vertical centerline of the upper portion of the back frame along a vector that is oriented 20 degrees or less from perpendicular to the vertical centerline and to the upper portion of the back frame, results in a substantially linear load vs. rearward deflection distance response measured at an upper corner of the upper portion.

10. The compliant chair backrest assembly of claim 1, wherein a deflection force positioned laterally offset from a vertical centerline of the upper back portion at the first frame side and along a vector that is oriented 20 degrees or less from perpendicular to the vertical centerline and angled laterally inward from the upper portion toward the vertical centerline, results in a substantially linear load vs. rearward deflection distance response measured at an upper corner of the upper portion.

11. The compliant chair backrest assembly of claim 1, wherein a deflection force positioned on a vertical centerline of the upper portion of the back frame along a vector that is oriented 20 degrees or less from perpendicular to the vertical centerline and to the upper portion of the back frame, results in a substantially linear load vs. lateral deflection distance response measured at an upper corner of the upper portion.

12. The compliant chair backrest assembly of claim 1, wherein a deflection force positioned laterally offset from a vertical centerline of the upper back portion at the first frame side and along a vector that is oriented 20 degrees or less from perpendicular to the vertical centerline and angled laterally inward from the upper portion toward the vertical centerline, results in a substantially asymptotic load vs. lateral deflection distance response measured at an upper corner of the upper portion.

13. The compliant chair backrest assembly of claim 1, wherein the upper portion of the back frame forms a central opening, the compliant chair backrest assembly further comprising a mesh back coupled across the central opening of the upper portion of the back frame.

14. The compliant chair backrest assembly of claim 13, further comprising an inner frame, the inner frame being coupled to the upper portion of the back frame to secure the mesh back to the upper portion of the back frame.

15. A chair including the backrest assembly of claim 1.

16. A method of making the backrest assembly of claim 1.

17. A compliant chair backrest assembly comprising:

a back frame having a first frame side, a second frame side, a lower portion and an upper portion that extends from the lower portion, the upper portion of the back frame being configured to engage with a back of a user and the lower portion including a first flexural member, a second flexural member, and a nexus, the first flexural member projecting in a lateral direction from the nexus such that the first flexural member defines a first lateral projection angle from the nexus, and the first flexural member defining a first lower contact surface and having a flexural rigidity; and a reinforcement support including a first brace and a second brace, the first brace defining a first upper contact surface and having a flexural rigidity that is greater than the flexural rigidity of the first flexural member, the first brace being selectively engageable with the first flexural member such that the first lower contact surface of the first flexural member progressively engages with the first upper contact surface of the first brace when the first flexural member is deflected, and the second brace being selectively engageable with the second flexural member such that the second flexural member progressively engages with the second brace when the second flexural member is deflected.

18. A compliant chair backrest assembly comprising:

a back frame having a first frame side, a second frame side, a lower portion and an upper portion that extends from the lower portion, the upper portion of the back frame being configured to engage with a back of a user and the lower portion including a first flexural member and a nexus, the first flexural member projecting in a lateral direction from the nexus such that the first flexural member defines a first lateral projection angle from the nexus, the first flexural member defining a first lower contact surface and having a flexural rigidity, the first lower contact surface of the first flexural member being defined by a plurality of spaced contact locations, and optionally, the plurality of spaced apart locations defining a discontinuous surface in a longitudinal direction along first lower contact surface; and a reinforcement support including a first brace defining a first upper contact surface and having a flexural rigidity that is greater than the flexural rigidity of the first flexural member, the first brace being selectively engageable with the first flexural member such that the first lower contact surface of the first flexural member progressively engages with the first upper contact surface of the first brace when the first flexural member is deflected.

19. A compliant chair backrest assembly comprising:

a back frame having a first frame side, a second frame side, a lower portion and an upper portion that extends from the lower portion, the upper portion of the back frame being configured to engage with a back of a user and the lower portion including a first flexural member and a nexus, the first flexural member projecting in a lateral direction from the nexus such that the first flexural member defines a first lateral projection angle from the nexus, the first flexural member defining a first lower contact surface and having a flexural rigidity, and the first flexural member forming a first pocket; and a reinforcement support including a first brace defining a first upper contact surface and having a flexural rigidity that is greater than the flexural rigidity of the first flexural member, the first brace being selectively engageable with the first flexural member such that the first lower contact surface of the first flexural member progressively engages with the first upper contact surface of the first brace when the first flexural member is deflected, and the first brace being at least partially receivable in the first pocket.

* * * * *